US006276350B1

(12) United States Patent
Davey

(10) Patent No.: US 6,276,350 B1
(45) Date of Patent: Aug. 21, 2001

(54) VARIABLE ANGLE TARGET LAUNCHER

(75) Inventor: Michael Davey, Scottsdale, AZ (US)

(73) Assignee: LaPorte, USA, Inc., Pounding Mill, VA (US)

( * ) Notice: Subject to any disclaimer, the term of this patent is extended or adjusted under 35 U.S.C. 154(b) by 0 days.

(21) Appl. No.: 09/662,934

(22) Filed: Sep. 15, 2000

(51) Int. Cl.[7] ..... F41J 9/18
(52) U.S. Cl. ..... 124/8
(58) Field of Search ..... 124/8, 9

(56) References Cited

U.S. PATENT DOCUMENTS

| | | | | |
|---|---|---|---|---|
| 2,677,361 | | 5/1954 | McIntire . | |
| 3,070,082 | | 12/1962 | Foster . | |
| 3,179,101 | * | 4/1965 | Luebkeman | 124/8 |
| 3,601,112 | | 8/1971 | Dale . | |
| 4,481,932 | * | 11/1984 | Olson | 124/8 |
| 4,706,641 | | 11/1987 | Cote | 124/8 |
| 4,967,720 | * | 11/1990 | McCord et al. | 124/8 |
| 4,976,249 | * | 12/1990 | Gagnon | 124/8 |
| 5,036,828 | | 8/1991 | Heffer | 124/47 |
| 5,249,563 | | 10/1993 | Patenaude . | |

* cited by examiner

*Primary Examiner*—John A. Ricci
(74) *Attorney, Agent, or Firm*—LaValle D. Ptak

(57) ABSTRACT

The throwing arm for a clay target launching machine is designed with an adjustable leading edge or target-engaging edge of the throwing arm. This edge is separately, pivotally mounted on a main body member, which in turn is pivoted to launch the targets. By adjusting the angle of the leading edge of the throwing arm, causing it to be offset from a center line through the central pivot of the main body member of the throwing arm, the angle between two simultaneously released targets can be varied from an angle which is less than that of conventional devices to an angle which is greater than that of conventional devices. A further enhancement includes constructing the leading edge of the throwing arm with materials of different coefficients of friction to provide additional variations in the angle at which targets are released by the machine in which the throwing arm is used.

19 Claims, 3 Drawing Sheets

FIG. 3
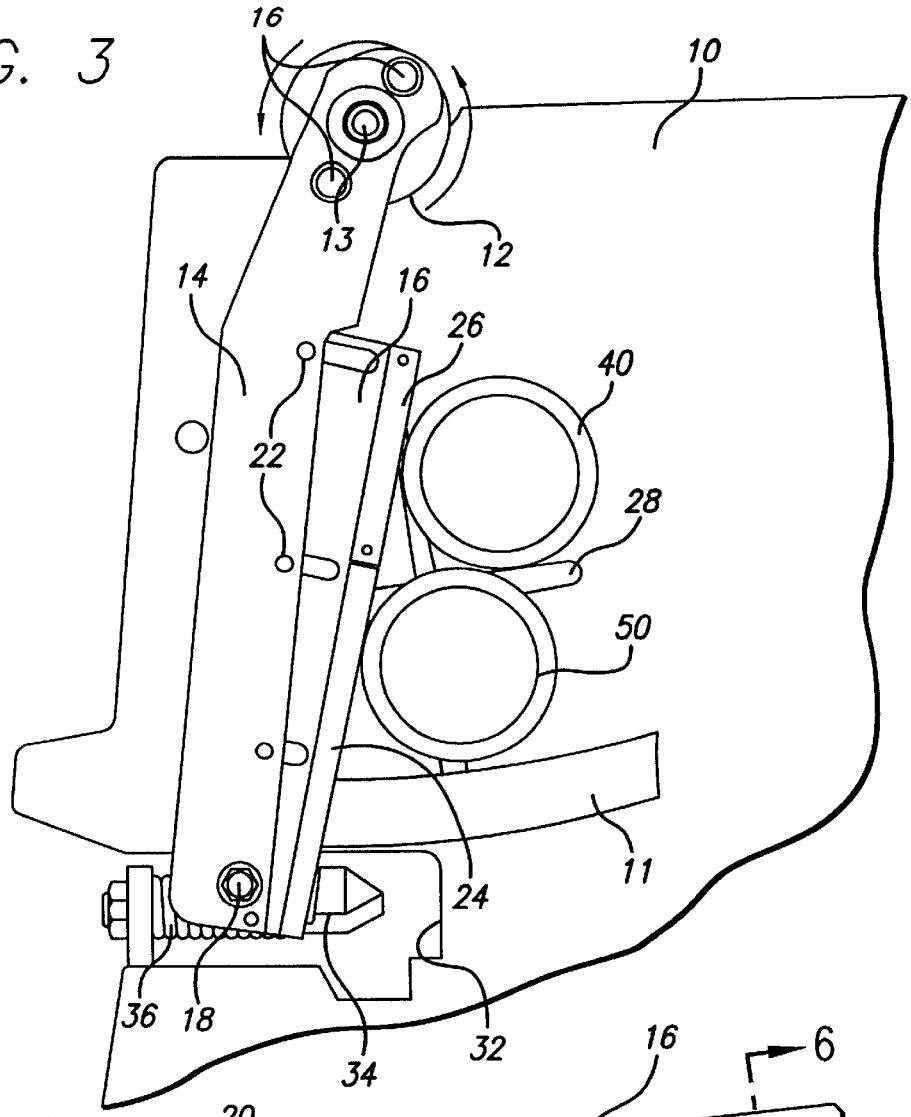
FIG. 4
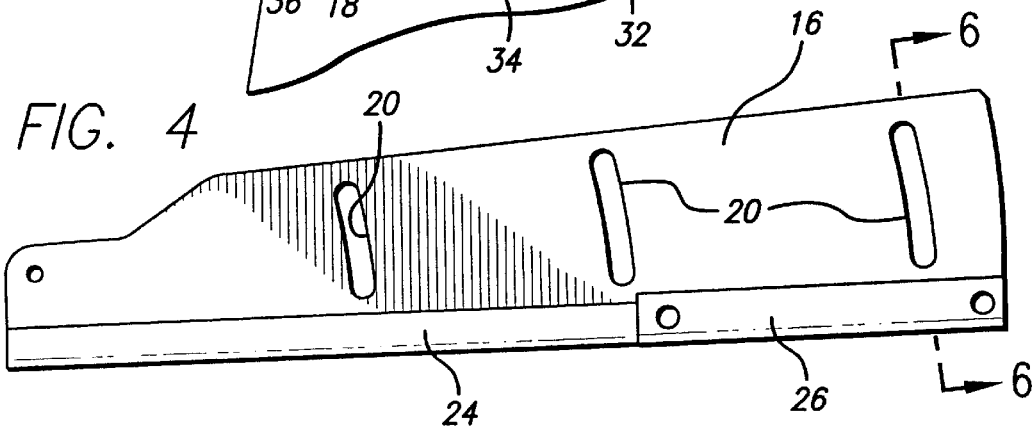
FIG. 5
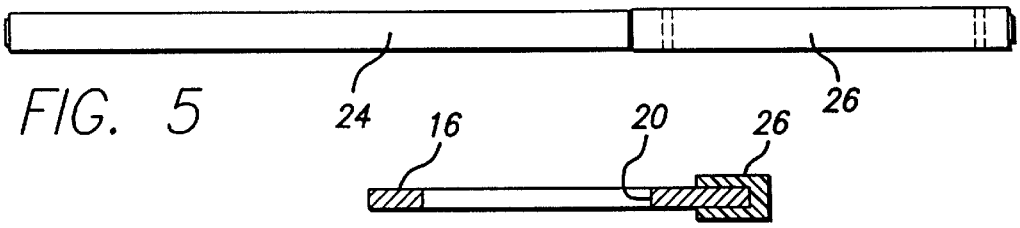
FIG. 6

VARIABLE ANGLE TARGET LAUNCHER

BACKGROUND

In the sport of skeet shooting, automatic and semiautomatic machines have been developed for throwing or launching frangible clay targets into the air for a shooter. These targets have been called "clay pigeons" and typically are in the form of circular, disc-like members having a slightly hollowed-out underside. When these frangible clay targets are launched, they are thrown and simultaneously spun; so that they sail through the air after launching.

Various types of machines have been developed in the past for launching single targets. Some of these machines place the target on a flat launching plate from which it is swept by a launching arm, which rapidly spins in a circular motion to sweep the target off the launching plate and launch it from the plate and the tip of the arm, as the arm completes a 360° revolution. Other devices place the target on a horizontal portion of a launching arm which has a vertical edge resting against the edge of the target. The arm carrying the target then is rapidly spun or snapped in a circular direction to launch the target, much in the same manner as targets are launched from the launching plate described above.

As the sport of skeet shooting or trap shooting has evolved, a demand has arisen for simultaneously or nearly simultaneously launching two targets at different angles from essentially the same position. A very complex mechanism for achieving this is disclosed in the United Kingdom patent specification No. 2,189,154. The device of this specification employs two separate throwing arms, loaded from two separate magazines, for accomplishing the simultaneous throwing of two targets. The throwing arms are essentially independent of one another; so that the targets may be released at various angles, depending upon the orientation of each of the arms with respect to one another. The device of this patent, however, basically is a combination of two single-arm throwing devices in a generally unitary housing. No throwing of more than one target from a single arm is disclosed in this patent.

Two United States patents, Heffer U.S. Pat. No. 5,036,828 and Cote U.S. Pat. No. 4,706,641, disclose devices for simultaneously throwing two targets with a single throwing arm. In both of these patents, the targets are dropped onto a horizontal portion of the throwing arm, and rest against a vertical portion. The entire arm, the part on which the bottom of the targets rest, as well as the part which pushes the targets away, is rotated to launch the targets. There is no separate fixed launch plate on which the targets are placed. As a consequence, the throwing arm has a relatively large amount of inertia because of the weight of the horizontal portion on which the targets are placed, since that portion, as well as the vertical edge which contacts the edges of the targets, all must be rotated along with the targets, to launch or release the targets.

The United States patent to Patenaude U.S. Pat. No. 5,249,563 is directed to an apparatus for simultaneously, or nearly simultaneously, throwing two clay targets (or, optionally, a single target) using a single throwing arm. The device of the Patenaude patent uses a flat launching plate of the type discussed above,. which long has been used for launching or throwing single targets. In the Patenaude device, the target holding carousel is designed to release two targets in front of the launching arm, which then is moved to its cocked or launching position with a vertical edge resting against the edges of the targets, which are located side-by-side in front of the arm. Upon release, the arm rapidly rotates and launches and spins both of the targets outwardly with a single pass of the arm. After launching, the arm is re-cocked; and new targets are inserted into place for a subsequent launch.

In conjunction with the prior art patents discussed above, and in fact with any device operating in the general manner described above for launching two targets, when the arm rotates (typically, in a counterclockwise direction), the targets both spin in a clockwise direction, and rotate down or along the length of the arm from its center location at the pivot toward its unsecured end. The targets then are launched at slightly different times. The target which is located nearest the end of the arm initially leaves first; and then the target initially located nearest the pivot arm leaves shortly after the first target.

The first target to leave the throwing arm typically travels about 22° off of a line which is located 180° from the line of the start of the launch. The second target then travels about 22° after that same line; so that there is an angle of 44° between the targets. This is the norm or convention for all traps or launchers which release two targets from a single arm. The angle is simply determined by the physics of the system, which includes the diameter of the clay targets (which is standard).

Accordingly, it is desirable to provide a skeet or trap launching machine in which the launching arm is adjustable to cause the angle between the released targets to be varied in a simple and effective manner.

SUMMARY OF THE INVENTION

It is an object of this invention to provide an improved throwing arm for a clay target launching machine.

It is another object of this invention to provide an improved throwing arm for simultaneously throwing two targets from a clay target launching machine.

It is an additional object of this invention to provide an improved throwing arm for simultaneously throwing two targets from a clay target launching machine which is capable of adjusting the angle between the launched targets.

It is a further object of this invention to provide a throwing arm for a clay target launching machine which has an angularly adjustable target-engaging edge for varying the launch angle between two targets simultaneously launched by the machine.

In accordance with a preferred embodiment of the invention, a variable angle throwing arm for a clay target launching machine comprises a main body portion which is rotated about a pivot for simultaneously launching pairs of targets. The main body portion has an elongated blade member attached to it, with a target-engaging edge on the blade member for engaging targets to be launched by the machine. The elongated blade member is adjustably secured by adjustment members to the main body member, to cause the target-engaging edge of the blade member to be oriented at different angles to effect different separation angles between the launched targets.

BRIEF DESCRIPTION OF THE DRAWINGS

FIG. 3 is a top view of the embodiment shown in FIG. 1 illustrating details of its operation;

FIG. 4 is a top view of the portion shown in FIG. 2;

FIG. 5 is a side view of the portion shown in FIG. 4;

FIG. 6 is a cross-sectional view taken along the line 6—6 of FIG. 4.

DETAILED DESCRIPTION

Figure 1:
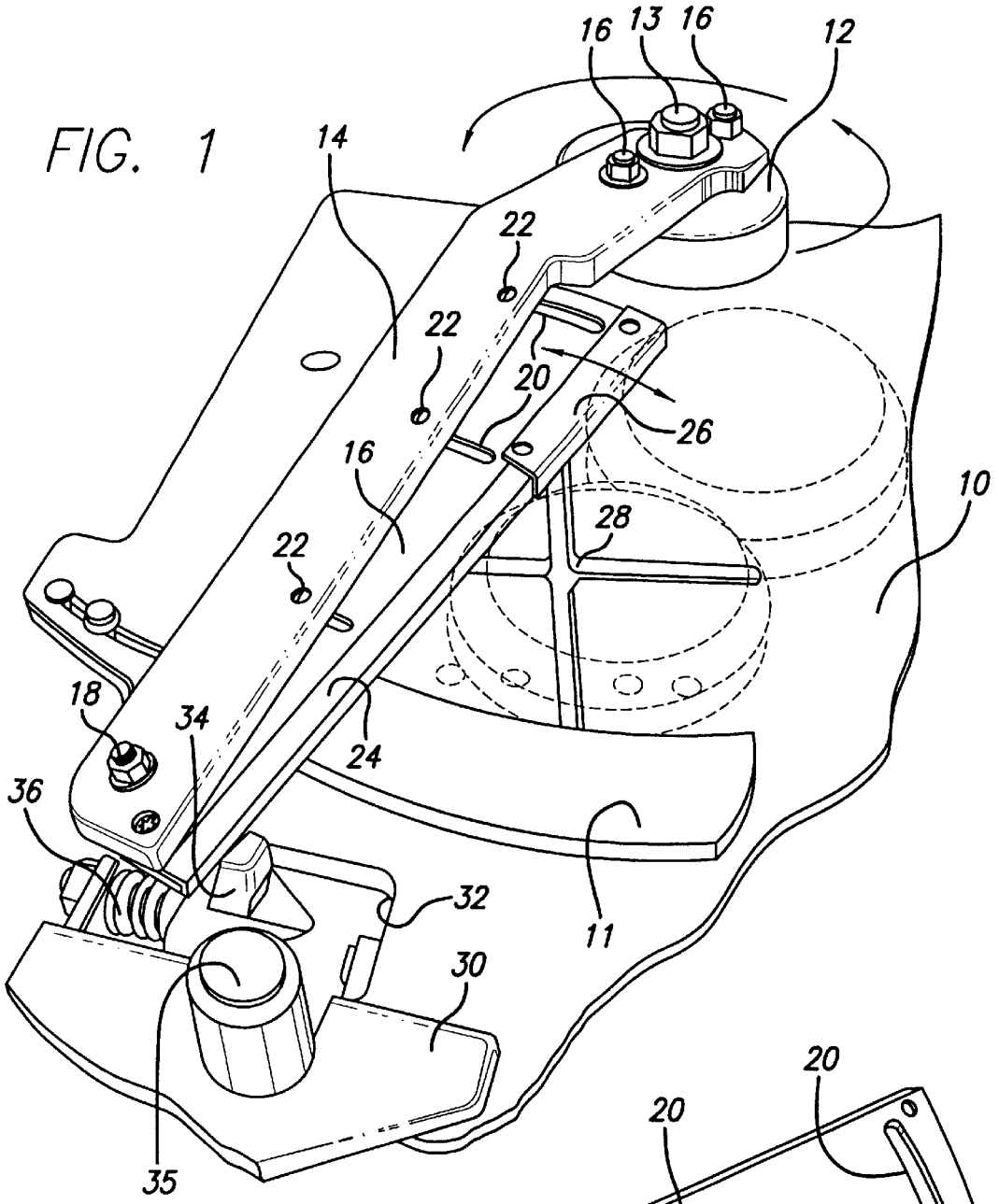
FIG. 1 is a top front perspective view of a preferred embodiment of the invention.

Reference now should be made to the drawings, in which the same reference numbers are used throughout the different figures to designate the same components. All of the figures are directed to a preferred embodiment of the invention, which is a throwing arm for frangible clay targets sometimes known as clay pigeons. The throwing arm is designed for use in target launching machines, which may be of any of a variety of commercially available configurations. For this reason, details of the machine mechanism for rotating, releasing and cocking the arm, as well as for placing targets in front of the arm prior to release, are not illustrated in the drawing. The details of such machines are well known, and are not important for an understanding of the invention. Only those portions of target launching machines or trap machines which are required for an understanding of the preferred embodiment of the invention have been illustrated in the drawings.

FIG. 1 is a top front perspective view of a preferred embodiment of the invention shown attached to portions of a clay target launching machine. Ideally, the launching machine with which the launching arm of the preferred embodiment of the invention is used employs a flat, steel launching plate 10, on which the targets are placed, and from which they are pushed and launched into the air by the launching arm. Machines of this type have been available for many years, particularly for the launching of single clay targets. The mechanism for placing targets in a launching position, as well as for rotating and cocking the launching arm are well known and standard.

In the device which is shown in the drawings, the launching arm comprises a main body portion, in the form of an elongated throwing arm 14, which is attached by means of suitable fasteners 16 to a rotating circular pivot member 12 fastened for rotation on the plate 10, through a central pivot 13. This is shown most clearly in FIGS. 1 and 3. The arrows in both FIGS. 1 and 3 indicate the counterclockwise direction of rotation of the arm 14 during its operation. The arm 14 makes a complete 360° revolution for each cycle of operation, rapidly spinning under the force of a cocked spring (the details of which are not shown, since they are standard configurations) from the cocked or start position shown in both FIGS. 1 and 3, through a full circle, back to the cocked or start position ready for release of a new cycle. The cycling may take place automatically or semiautomatically, depending upon the machine with which the embodiment of the invention is used.

Figure 2:
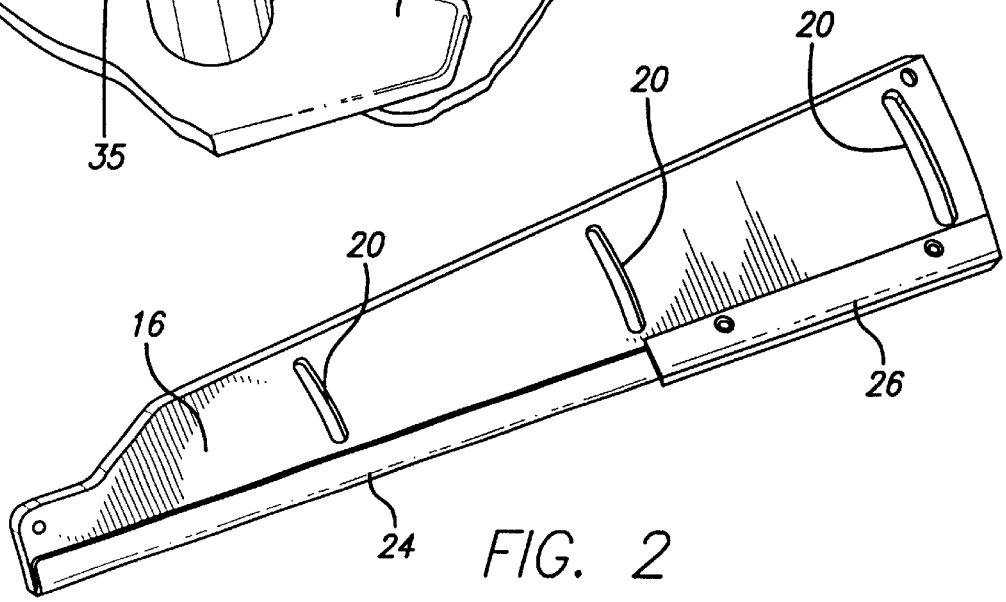
FIG. 2 is a detailed top rear perspective view of a portion of the embodiment shown in FIG. 1.

In accordance with a preferred embodiment of the invention, the leading edge (the right-hand edge as shown in FIGS. 1 and 3) of the main body portion 14 of the throwing arm has an elongated blade 16 attached to it. As illustrated, the blade member 16 is provided with a plurality of elongated arcuate slots 20 (shown most clearly in FIGS. 2 and 4) and is pivotally attached to the underside, or to an intermediate slot in, the arm 14, through a pivot 18 at the distal end of the arm 14 opposite the pivot 13 described above. This, again, is shown most clearly in FIGS. 1 and 3. Each of the slots 20 is aligned with a fastener 22 located along the leading edge of the throwing arm 14 to permit relative angular pivotal movement of the elongated blade 16 in the direction of the arrows shown in FIG. 1, back and forth from a position where the blade 16 parallels the leading edge of the arm 14 to a fully extended angular position, as illustrated in FIGS. 1 and 3. Once the desired angular position of the blade 16 has been established, the fasteners 22 are tightened to secure the blade in place on the arm 14.

It is readily apparent from an examination, particularly of FIG. 3, that the orientation of the leading or target-engaging edge (the right-hand edge) of the elongated blade member 16 creates an adjustment of the throwing position of the arm as it is rotated counterclockwise to release targets, such as the targets 40 and 50 shown in FIG. 3, from the target launching machine or trap machine.

The leading or target-engaging edge of the blade 16 is provided with a pair of adjacent sleeves 26 and 24. The sleeve 24 is approximately twice as long as the sleeve 26. The material of the sleeve 24 is chosen to be a relatively high friction material, such as rubber or the like. The sleeve 26, on the other hand, is made of relatively low friction material, such as nylon; so that as the targets 40 and 50 move along the sleeve, they are in contact with one or the other of these materials, which are used to impart spin to the targets and assist in launching them from the launching plate 10.

The entire front edge of the blade 16 could be covered with the same material, such as the material 24, to impart spin to the edges of the clay target discs 40 and 50, as is done in conjunction with conventional arms not having an adjustable blade. It should be noted that in conventional arms, where the launch is essentially effected from the leading or right-hand edge of for example the arm 14, targets are launched at an angle which is approximately 44° between them. This is due to the physics of such machines, and is relatively consistent in conjunction with a variety of different launching arm configurations, as discussed above in the background portion.

By allowing adjustability in any increment between parallel to the leading edge of the arm 14 to the extended position shown in FIGS. 1 and 3, the launching angle of the targets 40 and 50, relative to the radial direction of the spin of the arm 14 around the pivot 13, can be adjusted. This in turn allows the release angle of the targets 40 and 50 to be varied over a relatively wide range. This range is about 38° to 50°, using the configurations which are shown in the drawings.

By employing a very low friction surface 26 on the portion of the blade 16 located nearest the pivot 13, and a higher friction surface (such as a rubber surface) on the target contacting edge 24 of the blade 16, an even greater range of dispersal of the targets, particularly providing lower degrees of separation, can be provided. As shown in FIG. 3, when two targets 40 and 50 are placed in the launching position, the innermost target 40 has its edge resting against the low friction portion 26 on the leading edge of the blade 16. At the same time, the target 50 has its edge resting on the higher friction surface 24 on the leading edge of the blade 16. When launch is effected, the target 50 rolls along the higher friction edge 24, which imparts spin to it immediately.

Figure 7:
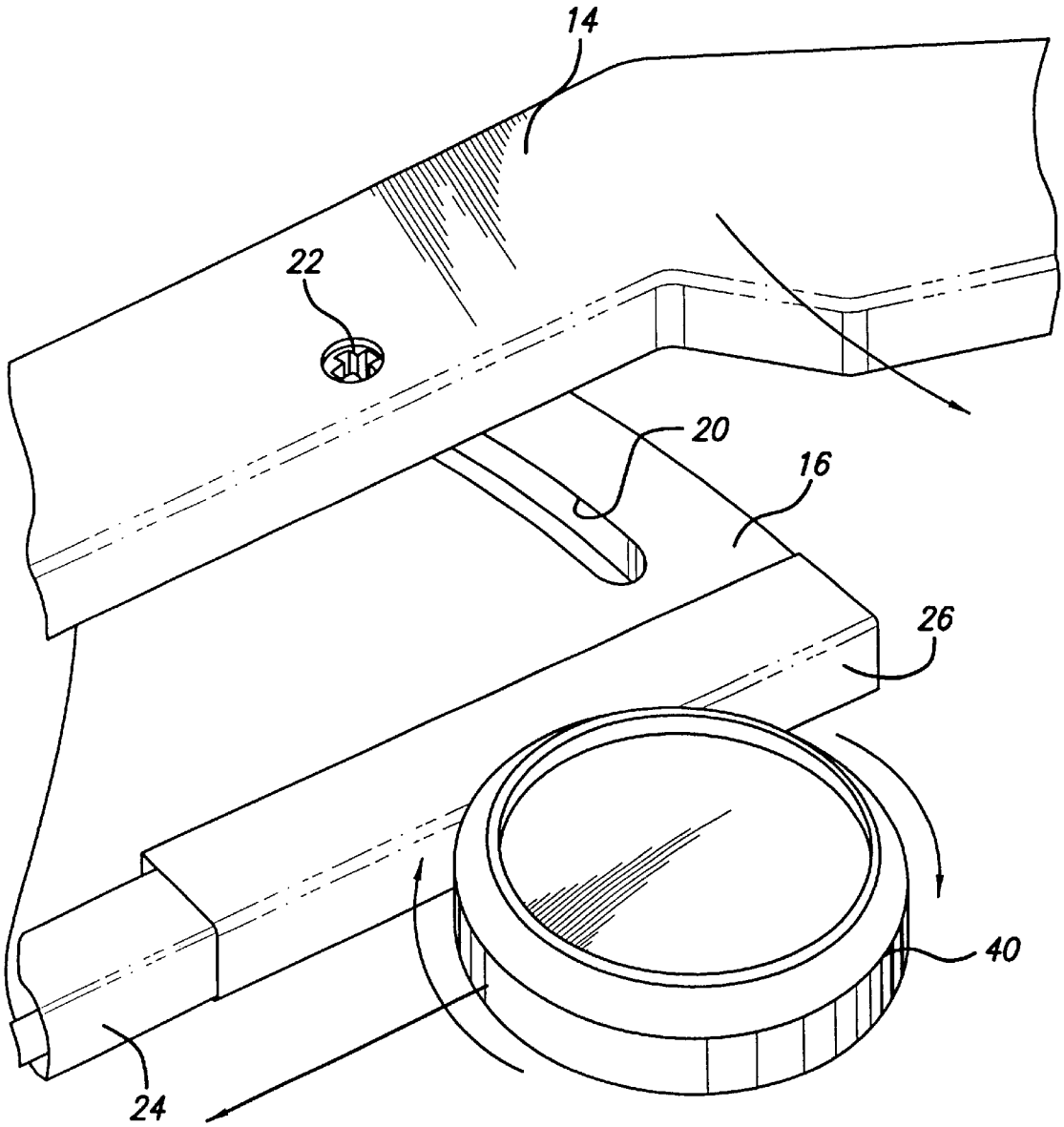
FIG. 7 is an enlarged top front perspective view illustrating a detail of the embodiment shown in FIG. 1.

The centrifugal force of the apparatus causes the target 40 to slide in the direction of the left-hand arrow shown in FIG. 7, along the surface 26, picking up some spin but not as much as it encounters when it reaches the section 24 during subsequent portions of the rotation of the throwing arm 14 when the targets 40 and 50 are being launched. Without this smooth surface of the section 26, the separation angle between the targets 40 and 50 is slightly greater than with this surface in place. Obviously, by varying the relative lengths of the sections 24 and 26, the difference in the separation angle which is attainable with the system is varied accordingly. This variation is in addition to any variation which is effected by the angular positioning of the leading edge of the blade 16 relative to the edge of the throwing arm 14.

It also should be noted that, in the example which is illustrated throughout the different figures, the arm 14 is offset from the center line through the pivot 13; so that there is a "hook" type of action in the illustrated throwing arm. The utilization of the adjustable blade 16, however, can be used in conjunction with straight throwing arms as well as the hook throwing arm shown. The variations in the angles between the targets 40 and 50, as they are thrown for different adjustments of the blade 16, are attainable with straight arms as well as with the hook arm shown in the various figures of the drawing.

As illustrated in FIGS. 1 and 3, a stop 34 is pivotally secured through a pivot 35, to a plate 30 in the launching machine. The stop 34 is used to keep the launching arm 14 in its cocked, ready-to-launch position until targets 40 and 50 are placed in front of the target-engaging edge of the blade 16, as illustrated in FIG. 3. The manner in which the targets are placed may be through any suitable apparatus. Slots 28 in the plate 10 are illustrated for accommodating a target lowering elevator, or the like. The manner in which targets 40 and 50, however, are placed is irrelevant to the function of the throwing arm; and for that reason, such mechanism has not been disclosed. Once the targets 4 and 50 are in place, the latch 34 is momentarily pivoted on the pivot 35 in the aperture 32 to move it out of the way of the end of the blade 16 and throwing arm 14. This allows the spring-loaded throwing arm to fling the targets 40 and 50 out of the machine. Once the arm has been released by the pivoting away of the stop 34, it is returned to the position shown in FIGS. 1 and 3 by suitable mechanism (not shown) to ready the machine for the next launch cycle.

Also shown in FIGS. 1 and 3 is a slightly raised circular section 11, which underlies the arm 14 and blade 16 to provide a low friction surface for the arm 14 and blade 16 during the launch cycle. This raised portion allows the sliding contact of the arm 14 and/or blade 16 over the launching plate 10 to be reduced to a relatively small area; so that friction encountered by the arm 14 and/or blade 16 during the launch cycle is minimized.

The foregoing description of the preferred embodiment of the invention is to be considered as illustrative and not as limiting. Various changes and modifications will occur to those skilled in the art to perform substantially the same function, in substantially the same way, to achieve substantially the same result, without departing from the true scope of the invention as defined in the appended claims.

What is claimed is:

1. A throwing arm for a clay target launching machine including in combination:

an elongated throwing arm having a main body portion with first and second ends;

a pivot member at the first end of the main body portion for pivoting the main body portion to launch one or more clay targets;

an elongated blade member having first and second ends and a target-engaging edge thereon, the second end of the blade member being pivotally mounted on the main body portion adjacent the second end thereof to extend outwardly from the main body portion; and at least one adjustment member for releasably securing the elongated blade member to the main body portion at different predetermined angles by pivoting the first end of the elongated blade member toward and away from the first end of the main body portion.

2. The throwing arm according to claim 1 wherein the target-engaging edge of the elongated blade member has a coefficient of friction designed to impart spin to targets engaged thereby during launching of the targets.

3. The throwing arm according to claim 2 wherein the main body member has a leading edge, and the adjustment member for releasably securing the elongated blade member to the main body portion causes the target-engaging edge of the adjustment member to be oriented at different predetermined angles to the leading edge of the main body portion.

4. The throwing arm according to claim 3 wherein the coefficient of the friction on the target-engaging edge of the elongated blade member is greater on some portions than on other portions.

5. The throwing arm according to claim 4 wherein the coefficient of friction on the target-engaging edge of the elongated blade member is lower on a portion thereof located near the pivot member, and is greater on a portion thereof located a greater distance from the pivot member than the portion located near the pivot member.

6. The throwing arm according to claim 1 wherein the target-engaging edge of the elongated blade member has a coefficient of friction designed to impart spin to targets engaged thereby during launching of the targets.

7. The throwing arm according to claim 6 wherein the coefficient of the friction on the target-engaging edge of the elongated blade member is greater on some portions than on other portions.

8. The throwing arm according to claim 7 wherein the first end of the blade member is located near the first end of the main body portion and wherein the target-engaging edge of the elongated blade member is comprised of first and second sections having different coefficients of friction, with the first section extending from the first end of the elongated blade member a predetermined distance toward the second end thereof, and the second section extending from the first section to the second end of the elongated blade member with the first section having a lower coefficient of friction than the second section.

9. The throwing arm according to claim 8 wherein the first section of the target-engaging edge of the elongated blade member is shorter than the second section thereof.

10. The throwing arm according to claim 9 wherein the coefficient of friction of the second section of the target-engaging edge of the blade member is substantially greater than the coefficient of friction of the first section thereof.

11. The throwing arm according to claim 10 wherein the first section of the target-engaging edge of the elongated blade member has a length which is substantially one-half the length of the second section of the target-engaging edge of the elongated blade member.

12. The throwing arm according to claim 1 wherein the main body member has a leading edge, and the adjustment member for releasably securing the elongated blade member to the main body portion causes the target-engaging edge of the adjustment member to be oriented at different predetermined angles to the leading edge of the main body portion.

13. The throwing arm according to claim 1 wherein the first end of the blade member is located near the first end of the main body portion and wherein the target-engaging edge of the elongated blade member is comprised of first and second sections having different coefficients of friction, with the first section extending from the first end of the elongated blade member a predetermined distance toward the second end thereof, and the second section extending from of the first section to the second end of the elongated blade member with the first section having a lower coefficient of friction than the second section.

14. The throwing arm according to claim 13 wherein the coefficient of friction of the second section of the target-engaging edge of the blade member is substantially greater than the coefficient of friction of the first section thereof.

15. A method for simultaneously launching two clay targets with differing angles between them including the steps of:

placing first and second targets in contact with the edge of a pivoted throwing arm;

adjusting the angle of the edge of the pivoted throwing arm relative to the radius of the circle of rotation of the throwing arm; and pivoting the throwing arm to launch targets therefrom.

16. The method according to claim 15 wherein the step of adjusting the angle of the leading edge of the throwing arm comprises pivoting the edge of the throwing arm to different predetermined angular positions.

17. The method according to claim 16 further including the step of forming the edge of the throwing arm of sections having different coefficients of friction to alter the speed and manner of movement of targets along the throwing arm when it is rotated to launch targets.

18. The method according to claim 17, wherein the step of forming the edge of the throwing arm with sections having different coefficients of friction includes the step of providing a lower coefficient of friction to the section of the edge of the throwing arm located nearest the pivot of the throwing arm.

19. The method according to claim 15 further including the step of forming the edge of the throwing arm of sections having different coefficients of friction to alter the speed and manner of movement of targets along the throwing arm when it is rotated to launch targets.

* * * * *